US005783316A

United States Patent [19]

Colella et al.

[11] Patent Number: 5,783,316

[45] Date of Patent: Jul. 21, 1998

[54] COMPOSITE MATERIAL HAVING HIGH THERMAL CONDUCTIVITY AND PROCESS FOR FABRICATING SAME

[75] Inventors: Nicholas J. Colella, Livermore; Howard L. Davidson, San Carlos; John A. Kerns; Daniel M. Makowiecki, both of Livermore, all of Calif.

[73] Assignee: Regents of the University of California, Oakland, Calif.

[21] Appl. No.: 703,914

[22] Filed: Aug. 22, 1996

Related U.S. Application Data

[62] Division of Ser. No. 247,090, May 20, 1994.

[51] Int. Cl.[6] ..... B23K 31/02

[52] U.S. Cl. ..... 428/660; 428/216; 428/312.2; 428/312.8; 428/317.9; 428/318.4; 428/319.1; 428/403; 428/323; 428/457; 428/613; 428/615; 428/634; 428/671; 428/674; 428/666; 428/665

[58] Field of Search ..... 428/613, 615, 428/634, 671, 674, 666, 665, 663, 660, 323, 457, 403, 216, 312.2, 312.8, 317.9, 318.4, 319.1

[56] References Cited

U.S. PATENT DOCUMENTS

| | | | |
|---|---|---|---|
| 3,868,234 | 2/1975 | Fontansela | 51/307 |
| 3,929,432 | 12/1975 | Caveney | 51/295 |
| 4,024,675 | 5/1977 | Naidich et al. | 51/307 |
| 4,062,660 | 12/1977 | Nicholas et al. | 51/295 |
| 4,373,934 | 2/1983 | Hayden | 51/309 |
| 4,686,080 | 8/1987 | Hara et al. | 428/697 |
| 4,776,862 | 10/1988 | Wiand | 51/293 |
| 4,899,922 | 2/1990 | Slutz et al. | 428/552 |
| 5,011,514 | 4/1991 | Cho et al. | 51/309 |
| 5,224,969 | 7/1993 | Chen et al. | 428/408 |
| 5,366,522 | 11/1994 | Nakamura et al. | 428/699 |
| 5,500,248 | 3/1996 | Lacovangelo et al. | 51/307 |

*Primary Examiner*—Archene Turner
*Attorney, Agent, or Firm*—L. E. Carnahan

[57] ABSTRACT

A process for fabricating a composite material such as that having high thermal conductivity and having specific application as a heat sink or heat spreader for high density integrated circuits. The composite material produced by this process has a thermal conductivity between that of diamond and copper, and basically consists of coated diamond particles dispersed in a high conductivity metal, such as copper. The composite material can be fabricated in small or relatively large sizes using inexpensive materials. The process basically consists, for example, of sputter coating diamond powder with several elements, including a carbide forming element and a brazeable material, compacting them into a porous body, and infiltrating the porous body with a suitable braze material, such as copper-silver alloy, thereby producing a dense diamond-copper composite material with a thermal conductivity comparable to synthetic diamond films at a fraction of the cost.

11 Claims, 2 Drawing Sheets

COMPOSITE MATERIAL HAVING HIGH THERMAL CONDUCTIVITY AND PROCESS FOR FABRICATING SAME

This is a Division of application Ser. No. 08/247,090 filed May 20, 1994 pending.

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to heat sinks for integrated circuits, particularly to copper-diamond heat sinks, and more particularly to a copper-diamond composite material such as that having high thermal conductivity and to a process for fabricating the composite material.

Diamonds and composites comprised of diamond particles embedded in a metal matrix have been used for various applications due to the hardness and heat conductivity of diamonds. Both diamonds and diamond/metal composites have been used extensively in industrial applications, such as various types of tools. Due to the cost of diamonds, various methods of forming diamond/metal composites and processes for forming tools of various shapes from such composites have been developed. This prior effort is exemplified by U.S. Pat. Nos. 2,382,666 issued Aug. 14, 1945 to I. A. Rohrig et al.; and No. 5,096,465 issued Mar. 17, 1992 to S. Chen.

With the advent of integrated circuits, and the need for adequate heat sinks therefor, researchers utilized substrates of diamonds and metals, such as copper, as a means for dissipating heat from the integrated circuits. For example, a Type II natural diamond has a thermal conductivity of 20 W/cmK compared to 4 W/cmK for copper. The high thermal conductivity of Type II diamond makes it the most attractive material for heat sink applications. Unfortunately, Type II diamonds are expensive and only available in relatively small sizes.

In efforts to resolve the cost and obtain sufficient heat dissipation, small sized diamonds (heat spreaders) were mounted in larger metal substrates (heat sinks), such as copper. Thus, performance was improved by mounting circuits on heat spreaders that increase the thermal footprint of the circuit resulting in more efficient cooling. These prior efforts are exemplified by U.S. Pat. Nos. 4,425,195 issued Jan. 10, 1984 to N. A. Papnicolaou; and No. 4,800,002 issued Jan. 24, 1989 to J. A. M. Peters.

Synthetic diamond films fabricated by a chemical vapor deposition (CVD) process (14 W/cmK) are almost comparable in heat conductivity to natural diamonds. However, the cost for these synthetic diamonds is still prohibitively expensive for mass produced electronic applications. Copper with a thermal conductivity of 4 W/cmK is a very attractive heat sink material. However, its high thermal expansion makes it incompatible with semiconductor materials and established integrated circuit fabrication processes. A similar problem exists with diamond because of its very low coefficient of thermal expansion. The brittle nature of diamond presents still another serious technical problem to its use as a thermal conducting substrate in large integrated circuit designs.

Diamond/metal composite materials are attractive for integrated circuit heat sinks because of the low-cost and the compatibility of thermal expansion with semiconductor materials (i.e. Ga, As, Si). The thermal conductivity and thermal expansion of a composite material are approximately equal to the volumetric average of the properties of the components in the composite. A composite material with 60% by volume of Type II diamond particles and 40% copper would have a thermal conductivity approximately equal to that of CVD diamond:

$$20\ \text{W/cmK}\ (0.6)+4\ \text{W/cmK}\ (0.4)\sim 13.6\ \text{W/cmK}$$

The thermal expansion of this composite material would be a similar fractional average of the thermal expansion of each component and similar to that of semiconductor materials.

Research efforts were also directed to the development of effective integrated circuit heat sinks using diamond/metal composites. They primarily involved hot-pressing of a diamond-metal powder compact as the fabrication technique. These composite development efforts are exemplified by U.S. Pat. Nos. 3,912,500 issued Oct. 14, 1975 to L. F. Vereschagin; No. 5,008,737 issued Apr. 16, 1991 to R. D. Burnham et al.; No. 5,120,495 issued Jun. 9, 1992 to E. C. Supan et al.; and No. 5,130,771 issued Jul. 14, 1992 to R. D. Burnham et al. While these efforts advanced this field of technology, modern high density integrated circuits are still limited in power, speed of operation, packing density, and lifetime by thermal considerations, and primarily the availability of suitable heat-sink material. While the prior hot-pressing techniques reduced the costs of fabricating the composite heat sinks, the thermal conductivity was low compared to the ideal value calculated for a diamond/metal composite. Thus, there has been a need for a low cost composite material which can effectively function as a heat sink or heat spreader for high density integrated circuits.

This need in the high density integrated circuit art is solved by the present invention which constitutes a new type of composite material with a thermal conductivity comparable to the calculated value based on the volumetric concentration of diamond and metal in the composite. This new material consists of up to 75% by volume diamond particles in a thermally conducting metal matrix (i.e. copper-silver). This matrix or composite material can be fabricated in relatively large sizes by a new process which involves infiltration rather than hot pressing. The use of diamond powder coated with layers of different metals allows the intimate bonding to the metal matrix material required for optimum thermal conductivity.

SUMMARY OF THE INVENTION

It is an object of the present invention to provide an improved heat sink or spreader for integrated circuits.

A further object of the invention is to provide a process for fabricating a dense diamond-copper composite material.

A further object of the invention is to provide a process for preparing diamond powder adherently coated with one or more metals.

Another object of the invention is to provide a process using infiltration for producing a material which has a thermal conductivity between copper and diamond and at a fraction of the cost of CVD diamond film.

Another object of the invention is to provide a process by which heat sink material can be fabricated in large thin sheets with several times the thermal conductivity of pure copper.

Other objects and advantages of the present invention will become apparent from the following description. The invention involves a matrix or composite material produced by a process using a liquid metal infiltration technique. The process basically involves three general operations consisting of: 1) coating diamond powder with one or more elements, 2) compacting them into a porous body, and 3) infiltrating with a suitable liquid metal such as copper or a copper alloy, such as copper-silver. The process produces a dense diamond-copper composite material with enhanced thermal conductivity which is between that of pure copper and synthetic CVD diamond films. This high thermal conductivity composite material consists of up to 75% by volume of diamond powder or particles in a thermally conducting metal matrix. This composite material can be fabricated in small and relatively large sizes and in large thin sheets, using inexpensive materials.

BRIEF DESCRIPTION OF THE DRAWINGS

The accompanying drawings, which are incorporated into and form a part of the disclosure, illustrate an apparatus and process for fabricating an embodiment of the invention and, together with the description, serve to explain the principles of the invention.

DETAILED DESCRIPTION OF THE INVENTION

Figure 1:
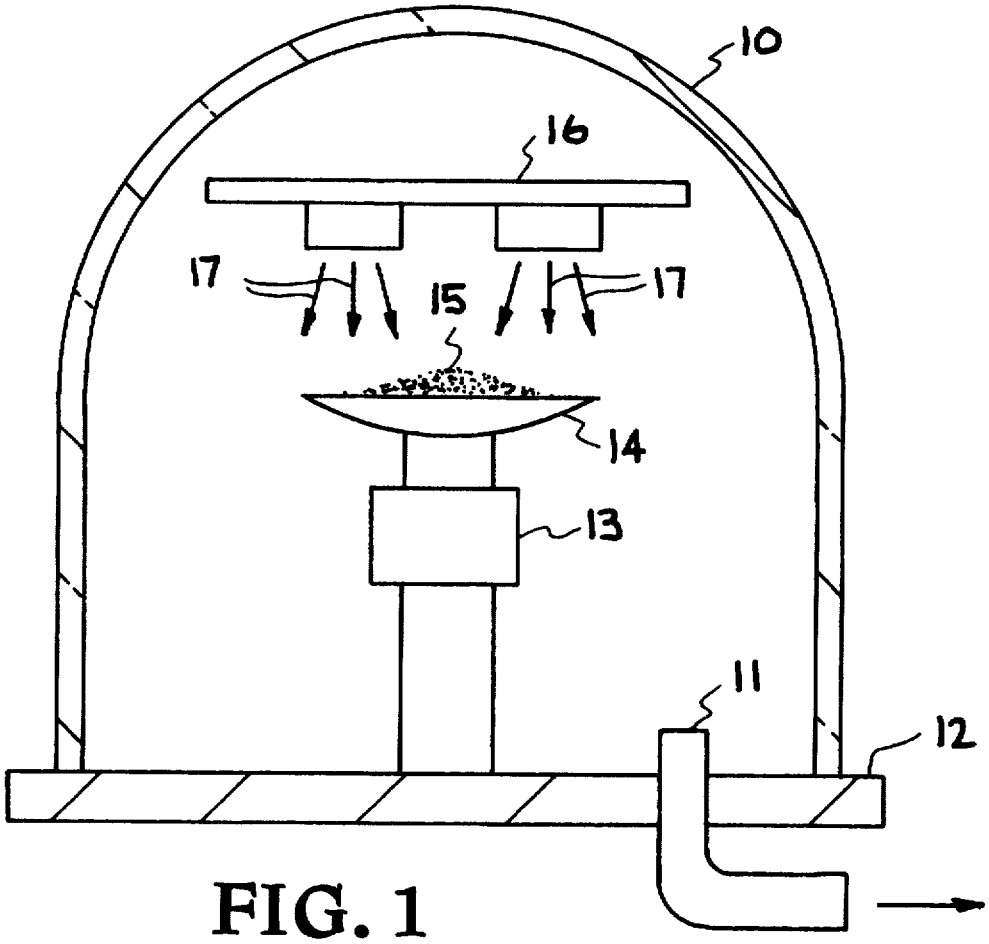
FIG. 1 illustrates an embodiment of an apparatus used in coating diamond particles in the fabrication process of the invention.

The invention is directed to a composite material having high thermal conductivity and to a process for fabricating the material. While the concept of improving the thermal conductivity of copper by adding high thermal conductivity diamond particles is known in the art, there is a lack in the art of a diamond-copper composite material with enhanced thermal conductivity to function effectively as a heat sink or heat spreader for modern high density integrated circuits. The composite material of this invention can be fabricated using inexpensive materials and in relatively large sizes or in large thin sheets with a thermal conductivity between that of pure copper and CVD diamond films. Basically, the material of this invention consists of up to 75% by volume diamond particles in a thermally conducting metal material (i.e. copper-silver). The process for producing the composite materials involves three (3) basic steps or operations comprised of: 1) coating, as by sputtering, diamond particles with several elements, 2) compacting them into a porous body, and (3) infiltrating the porous body with a suitable liquid metal. These three general fabrication steps of sputter coating, forming a porous compact, and metal infiltration, are described in a greater detail individually, as follows:

Sputter Coating

The process begins by sputter coating suitable diamond powder or particles with a thin layer or region (thickness of 100 to 10,000 Å) of an adherent carbide forming element (i.e. W, Zr, Re, Cr, Ti) followed by a thicker layer or region (thickness of 0.1 to 10 microns) of a brazeable metal (i.e. Cu, Ag). Essential parts of the process include: initial helium strip to remove static charge and adsorbed contaminants, in-situ deposition of the carbide forming element and the brazeable metal to prevent an oxide interface, and several intermediate screenings of the diamond powder or particles coated with the brazeable metal to break up agglomerates. The diamond powder consists of particles from 1–100 microns in diameter. It is essential that each particle is uniformly and completely coated with both the carbide forming element and the brazeable metal. This is accomplished by agitating a specific amount (approximately one gram) of diamond powder in a pan or container oscillated at high frequencies (28.01 to 28.99 kHz), by a piezoelectric crystal, for example. The amount of powder coated in a single pan is limited only by the size of the pan that can be vibrated at high frequencies by a piezoelectric crystal and a suitable power supply. This apparatus is known in the art and a detailed description thereof is not deemed necessary for an understanding of the process. The process can include additional deposition of the brazeable metal (i.e. Ag, Cu) by electroplating or electroless plating. Plating is a lower cost and more rapid deposition technique that is acceptable for increasing the thickness of the brazeable metal only.

Forming A Porous Compact

The sputter coated diamond powder or particles must be compacted into a solid porous (porosity of 30 to 80%) monolith prior to infiltrating with metal. The porous compact must be sufficiently stable to maintain its dimensions during the infiltration process. Compaction is accomplished by compressing the coated diamond powder in a die or by compressing it in an annealed copper ring that confines the powder. The pressure required for compaction will be determined by the diameter of the diamond particles and the quantity of coating on the diamond powder being compressed. For example, a pressure of 2000 Psi would be sufficient to compact 25 micron diamond powder when the metal is 30% of the total weight of the coated powder. Compacts can be made stronger to survive the infiltration process by a separate vacuum sintering process at 600° to 800° C. Both compaction dies and annealed copper ring apparatus are well known in the art.

Metal Infiltration

The porous coated diamond powder compact, having a size of 2.0 by 1.5 by 0.06 inches, for example, is placed on an appropriate amount of braze metal, such as sheets of either copper, silver, or a Cu—Ag alloy. The porous diamond compact and braze metal is heated in a vacuum furnace to a temperature above the melting point of the braze metal. The vacuum furnace is under a vacuum of less than $1\times10^{-3}$ Torr, for example, with the melting point of copper being 1085° C., silver being 962° C., and the Cu-72% Ag alloy being 780° C. The temperature in the vacuum furnace may typically be 2° to 20° C. above the melting point of the braze metal. Capillary forces, associated with the pore size of the powder compact, cause the braze metal to infiltrate into the porous compact. The time involved will be dependent on the size of the porous diamond compact, the type of braze metal or metals involved in the infiltration process, and the temperature of the furnace. For example, with a Cu—Ag alloy braze material, a porous compact of 2.0 by 1.5 by 0.06 inches, and a furnace temperature of 780° C.+10° C., the time required to produce the composite material would be up to 0.5 minutes. Vacuum furnaces are well known and a detailed description thereof is not deemed necessary to enable one skilled in the art to carry out the above-described infiltration process.

The following is a specific example of the detailed operations or steps involved in carrying out the process and producing a composite material in accordance with the present invention, using tungsten as the carbide forming element for forming the first or thin layer on the diamond particles having a diameter of 22 to 30 microns, wherein the following or thicker layer of brazeable metal is copper, and using braze metal sheets of copper –72% weight percent silver in the vacuum furnace. Fabrication Process:

A three step process is involved in the fabrication of the high thermally conducting composite material of this invention which consists of up to 75% by volume diamond particles in a copper or copper alloy matrix.

Step I involves sputter coating the diamond powder or particles (22 to 30 micron diameter) with a thin initial layer or region of a carbide forming metal (tungsten) and a thicker layer or region of a brazeable metal (copper). The coating process is accomplished in a 12 inch diameter glass bell jar vacuum system equipped with two 1 inch diameter magnetron sputtering sources, as shown in FIG. 1 and comprising a vacuum bell jar 10, vacuum line 11 in the base 12 of the bell jar 10 which supports a piezoelectric crystal assembly 13 and a pan 14 containing diamond powder or particles 15, two 1the two 1 inch diameter magnetron sputter sources, indicated generally at 16, positioned above the pan 14 and which produce metal atoms 17 for coating the diamond particles 15 which are being vibrated by the piezoelectric crystal assembly 13. One of the sputter sources has a tungsten target with other sources having a copper target. The sputter sources 16 are positioned 3.75 inches from the diamond powder 15 contained in pan 14 comprising a 2.5 inch diameter stainless steel pan. The pan 14 is vibrated at 28.77 kHz by the piezoelectric crystal assembly 13. Prior to metal coating the diamond powder is cleaned and static charges are removed by exposure to a helium gas plasma created by magnetron sputtering a tungsten target at 30 watts D.C. power. The helium gas pressure is maintained at 60 millitorr (m Torr) with a flow rate of 20 sccm. After helium sputter cleaning for 6 minutes the helium gas is replaced with high purity argon at 5.5 m Torr and a flow rate of 20 Sccm. The magnetron sputtering source with the tungsten target is restarted and run at 30 watts for 94 minutes. The magnetron sputter source with the copper target is thereafter started and run for 42 minutes at 20 watts of D.C. power. The codeposition of a region of blended tungsten and copper establishes a blended interface between the layers or regions of these separate metals without oxide contamination. The blended region will vary from 0 to 100% of each metal. The tungsten sputter source is turned off and copper is deposited at 20 watts for 48 minutes and then at 60 watts for an additional 48 minutes. At this point in the process the diamond particles have been uniformly coated with approximately 100 Å of tungsten and 1000 Å of copper. Additional copper can be applied by sputtering; however, cold-welding will occur requiring periodic screening to break up agglomerates of the coated diamond powder. Also, the codeposited region of blended copper and tungsten may be modified to establish a sharp interface between the individual layers of copper or tungsten, although the blended layer approach is preferred.

The diamond powder sputter-coated with tungsten and copper can then be pressed into compacts for liquid metal infiltration, as described in Steps 2 and 3 hereinafter. However, the strength of the pressed compacts is increased dramatically by substantially increasing the copper coating thickness. This may be accomplished by either electroplating or electroless copper plating instead of sputtering because of the added economy, convenience, and higher deposition rates of the plating processes. For example a Sel Rex Circuit Prep 554 electroless copper plating solution is used at a ratio of 166 ml per gram of sputter-coated diamond particles. The plating process takes 12–15 minutes and increases the copper coating to about 30% of the total weight of the coated particles. The electroless plating both is vigorously stirred and heated to 40° C. The plated particles or powder is rinsed with deionized water and ethanol and dried with infrared lamps.

Figure 2A:
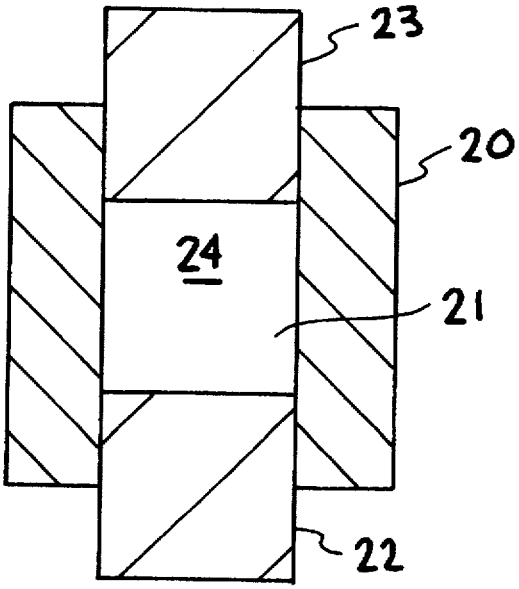
FIGS. 2A and 2B illustrate an apparatus for compacting the coated diamond particles into a porous body using a die.
Figure 2B:
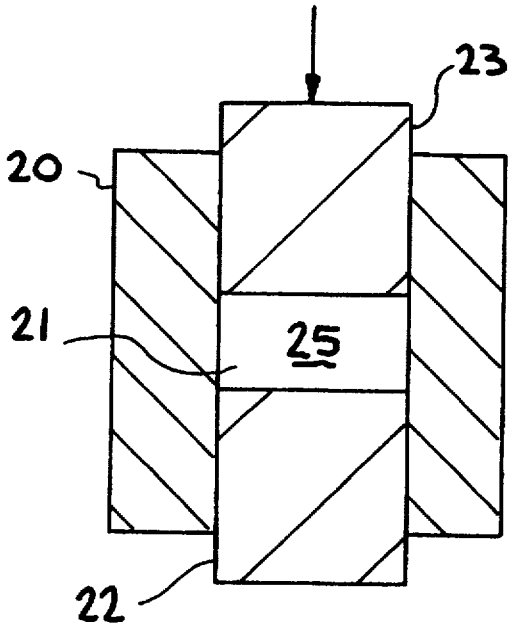
Figure 3A:
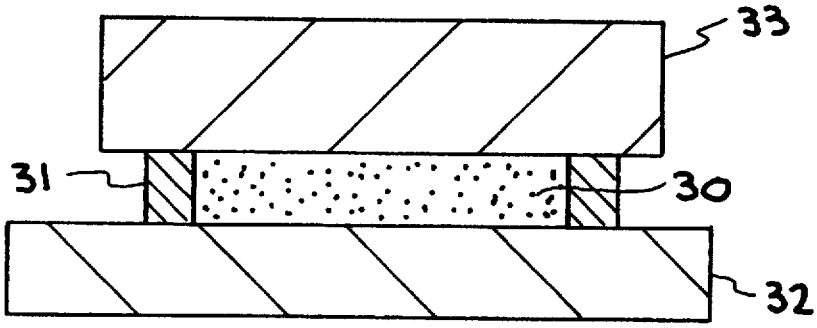
FIGS. 3A and 3B illustrate the compaction of a loose fill of coated diamond powder in a copper gasket.
Figure 3B:
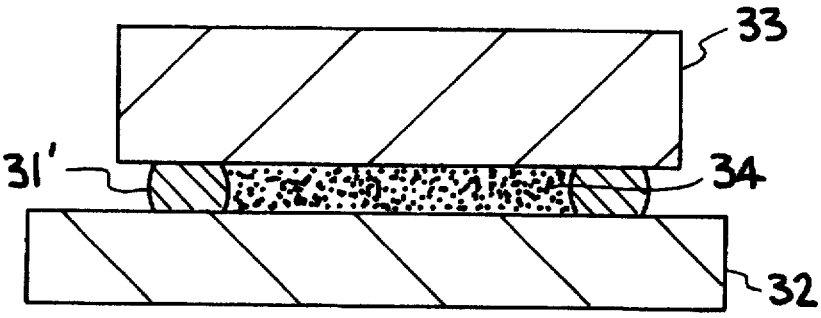

Step II involves the forming of porous compact from the coated diamond powder. The porous compact can be formed by pressing in a steel die to a maximum pressure of 2000 Psi, as illustrated in FIGS. 2A and 2B; or by filling a copper gasket or ring with the coated powder and pressing it to a specific thickness, as illustrated in FIGS. 3A and 3B. In carrying out the compaction of the coated diamond powder or particles in the approach illustrated in FIGS. 2A and 2B, a conventional compaction die 20 having a cavity 21 defined by a fixed member 22 and a movable punch or member 23, is loose filled with coated diamond powder or particles 24 produced by the process of Step I above, as shown in FIG. 2A. Pressure, up to 2000 Psi, indicated by the arrow and legend, is applied to the punch 23 forcing same downward, as shown in FIG. 2B, which results in a porous coated diamond compact 25. In carrying out the compaction of the coated diamond powder or particles in the approach illustrated in FIGS. 3A and 3B, the 22–30 micron diameter coated diamond powder or particles 30 plated in Step I is loose poured into a 1.0 by 0.5 inch rectangular copper gasket or ring indicated at 31 in FIG. 3A, with gasket 31 being 0.062 inch thick and located on a support or member 32, and is pressed by a top punch or member 33 at a pressure of up to 2000 Psi, to form a compacted diamond powder or compact indicated at 34 within compacted ring 31' in FIG. 3B, having a thickness of 0.045 inch.

Figure 4A:
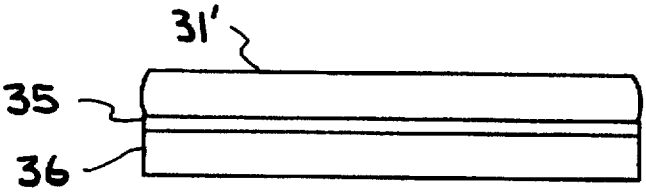
FIGS. 4A and 4B illustrate the infiltration operation of the fabrication process.
Figure 4B:
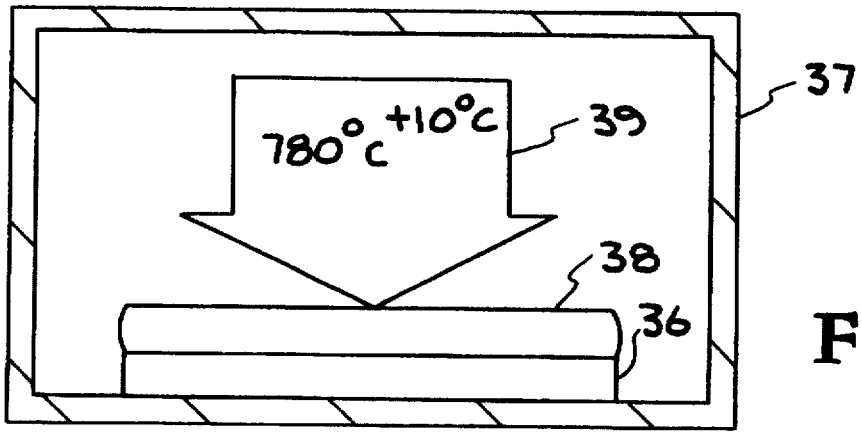

Step III involves infiltrating the porous compact, formed by the approach illustrated by FIGS. 2A–2B or 3A–3B, with a liquid metal. Using the compaction approach of FIGS. 3A–3B, the compacted powder 34 still in the copper gasket 31' is placed on a sheet 35 of braze alloy (copper –72% by weight silver alloy), which is supported by a ceramic support member 36, as seen in FIG. 4A. The copper alloy sheet 35 is of the same dimensions as the copper gasket 31 (1.0 inch by 0.5 inch) and has a thickness of 0.015 inch, with the copper gasket 31' having a thickness of 0.045 inch. This thickness of the braze alloy sheet 35 was predetermined empirically to completely infiltrate the porous diamond compact 34. The braze alloy sheet 35 and compact 34 with ring 31' are heated to 770° C. in a vacuum furnace 37 for 15 minutes. The temperature is allowed to stabilize at 770° C. for a 2–5 minute soak. The assembly is then heated above the 780° C. melting point a maximum of 10° C., as indicated by the arrow 39, to melt the braze alloy for infiltration by capillary action into the diamond compact. The infiltrated composite 38, see FIG. 4B, is held at liquidus temperatures for a maximum of 30 seconds and cooled to 50° C. before removing from the vacuum furnace. The finished composite material 38 is approximately the same thickness as the pressured porous compact (0.045 inch).

It has thus been shown that the above-described process produces a composite material having a thermal conductivity of at least 4.0 W/cmK, depending on the composition of the composite material. Thus, this composite material, made from inexpensive materials, i.e., diamond powder used for grinding and polishing applications, has a thermal conductivity greater than pure copper. In addition, this composite material has a thermal expansion of 7.6 ppm/°C. The conductivity comparable to pure copper. However, the substitution of a better quality diamond powder (i.e., diamond powder from a CVD process) will produce composite material with a thermal composite material can be produced in small quantities and sizes or as large thin sheets (4.0×4.0×

0.06 inches) for example, and thus can be effectively utilized as heat sinks or heat spreaders in high density integrated circuits, without the cost of material having a similar thermal conductivity. While coating of the particles is preferably by sputtering techniques, other effective techniques for coating the diamond particles, such as CVD or PVD, may be used.

There are definite advantages to coating the diamond powder by sputter deposition techniques. Sputtering allows the greatest number of materials to be deposited either sequentially or codeposited on the diamond powder. This allows the best selection of materials for adhesion to the diamond surface and compatibility with the infiltrating metal. Also, sputtering allows in-situ deposition of the layers or regions of materials thus promoting good adhesion between layers or regions.

The sputter deposition process produces the adherent metal layers or regions that are primarily responsible for the excellent thermal conductivity of the copper-diamond composite material. This process of coating powders by sputter deposition can be used to prepare improved diamond-metal composite grinding tools and to improve the properties of ceramic-metal composite materials in general.

While particular materials, operational sequences, parameters, etc. have been set forth to provide a description of the process and composite material of this invention, the invention is not limited to the specifics described above. Modifications and changes will become apparent to those skilled in the art, and the invention should be limited only by the scope of the appended claims.

We claim:

1. A composite material containing a brazeable material and diamond particles constituting up to 75% by volume of the composite materials, and having a thermal conductivity of at least that of copper and less than natural diamond produced by coating diamond particles with regions of selected materials, compacting the coated diamond particles into a porous body of substantially the desired configuration of the composite material, and infiltrating the porous body with a selected braze material.

2. The composite material of claim 1, wherein the regions of selected materials comprise a first layer of a carbide forming element, and a second and thicker layer of the brazeable material.

3. The composite material of claim 2, additionally including a region of blended carbide forming element on the brazeable material.

4. The composite material of claim 2, wherein the braze material is selected from the group of Cu, Ag, and a Cu—Ag alloy.

5. The composite material of claim 2, wherein the layer of carbide forming element is selected from the group of consisting W, Zr, Re, Cr, and Ti and alloys thereof, and wherein the layer of brazeable material is selected from the group consisting of Cu, Ag, and Cu—Ag alloys.

6. The composite material of claim 5, wherein the diamond particles have a diameter of about 1–100 micrometers.

7. The composite material of claim 6, wherein the infiltrating of the porous body is carried out in a vacuum furnace and at a temperature above the melting point of the braze material, whereby capillary forces associated with the porosity of the porous body cause the melted braze material to infiltrate into the porous body producing the composite material.

8. The composite material of claim 7, wherein the diamond particles are agitated during coating thereof to ensure uniform and complete coating of each of the layers of selected materials.

9. The composite material of claim 8, wherein the diamond particles are agitated in a container oscillated at high frequencies by a piezoelectric crystal.

10. The composite material of claim 1, wherein the coating includes an interconnecting section composed of a carbide forming element and a brazeable metal which establishes an interface between the regions without oxide contamination.

11. The composite material of claim 2, wherein the first layer has a thickness of 100–10,000 Å, and the second layer has a thickness of 0.1–10 microns.

* * * * *